US010134525B2

(12) United States Patent
Nishimura

(10) Patent No.: US 10,134,525 B2
(45) Date of Patent: Nov. 20, 2018

(54) DUST CORE AND CHOKE

(75) Inventor: Kazunori Nishimura, Tottori (JP)

(73) Assignee: HITACHI METALS LTD., Tokyo (JP)

( * ) Notice: Subject to any disclaimer, the term of this patent is extended or adjusted under 35 U.S.C. 154(b) by 304 days.

(21) Appl. No.: 12/992,842

(22) PCT Filed: May 12, 2009

(86) PCT No.: PCT/JP2009/058813

§ 371 (c)(1),
(2), (4) Date: Nov. 15, 2010

(87) PCT Pub. No.: WO2009/139368

PCT Pub. Date: Nov. 19, 2009

(65) Prior Publication Data

US 2011/0080248 A1 Apr. 7, 2011

(30) Foreign Application Priority Data

May 16, 2008 (JP) ..... 2008-129337

(51) Int. Cl.
*H01F 41/02* (2006.01)
*H01F 3/08* (2006.01)
(Continued)

(52) U.S. Cl.
CPC ..... *H01F 41/0226* (2013.01); *B22F 1/0003* (2013.01); *H01F 3/08* (2013.01);
(Continued)

(58) Field of Classification Search
CPC .... B22F 1/003; B22F 1/0055; B22F 2999/00; B22F 9/04; B22F 9/082; B22F 2009/048;
(Continued)

(56) References Cited

U.S. PATENT DOCUMENTS 5,815,060 A * 9/1998 Matsumoto et al. ..... 336/175
5,976,274 A * 11/1999 Inoue et al. ..... 148/304
(Continued)

FOREIGN PATENT DOCUMENTS

EP 0 655 753 A1 6/1995
JP 8-250358 A 9/1996
(Continued)

OTHER PUBLICATIONS

"Particles Sizes Explained." www.rimworld.com. Web. http://www.rimworld.com/nassarocketry/pdfs/005-PARTICLE%20SIZES.pdf ("Nassa").*

(Continued)

*Primary Examiner* — Holly C Rickman
*Assistant Examiner* — Lisa Chau
(74) *Attorney, Agent, or Firm* — Birch, Stewart, Kolasch & Birch, LLP

(57) ABSTRACT

The present invention provides a dust core including, as principal components, a pulverized powder of an Fe-based amorphous alloy ribbon; and a Cr-containing Fe-based amorphous alloy atomized spherical powder, and the pulverized powder is in the shape of a thin plate having two principal planes opposing each other, and assuming that a minimum dimension along a plane direction of the principal planes is a grain size, the pulverized powder includes a pulverized powder with a grain size more than twice and not more than six times as large as a thickness of the pulverized powder in a proportion of 80 mass % or more of the whole pulverized powder and includes a pulverized powder with a grain size not more than twice as large as the thickness of the pulverized powder in a portion of 20 mass % or less of the whole pulverized powder.

7 Claims, 4 Drawing Sheets

25 μm

(51) Int. Cl.

| | |
|---|---|
| ***B22F 1/00*** | (2006.01) |
| *H01F 1/153* | (2006.01) |
| *H01F 27/255* | (2006.01) |

(52) U.S. Cl.
CPC ..... *H01F 41/0246* (2013.01); *B22F 2999/00* (2013.01); *H01F 1/15308* (2013.01); *H01F 1/15366* (2013.01); *H01F 1/15375* (2013.01); *H01F 27/255* (2013.01)

(58) Field of Classification Search
CPC .... H01F 41/0226; H01F 41/0246; H01F 3/08; H01F 1/15308; H01F 1/15366; H01F 1/15375; H01F 27/255
See application file for complete search history.

(56) References Cited

U.S. PATENT DOCUMENTS

| | | | | |
|---|---|---|---|---|
| 7,172,660 | B2 * | 2/2007 | Song et al. ..... | 148/104 |
| 2005/0028889 | A1 | 2/2005 | Song et al. | |
| 2006/0170524 | A1 * | 8/2006 | Fujiwara ..... | H01F 1/15366 336/83 |
| 2007/0144614 | A1 * | 6/2007 | Lu et al. ..... | 148/105 |
| 2010/0001226 | A1 | 1/2010 | Aramaki et al. | |

FOREIGN PATENT DOCUMENTS

| | | | | |
|---|---|---|---|---|
| JP | 9-102409 | A | | 4/1997 |
| JP | 11-513200 | A | | 11/1999 |
| JP | 2002-249802 | A | | 9/2002 |
| JP | 2002249802 | A | * | 9/2002 |
| JP | 2005-57230 | A | | 3/2005 |
| JP | 2006179621 | A | * | 7/2006 |
| JP | 2009019259 | A | * | 1/2009 |
| WO | WO 98/06113 | A1 | | 2/1998 |
| WO | WO 2008/053737 | A1 | | 6/2008 |

OTHER PUBLICATIONS

Extended European Search Report dated May 19, 2011 in European Patent Application No. 09 74 6575.
Korean Office Action dated Sep. 3, 2012, for Korean Application No. 10-2010-7028067 with the English translation.

* cited by examiner

25 μm

25 μm

DUST CORE AND CHOKE

This application is the national phase under 35 U.S.C. § 371 of PCT International Application No. PCT/JP2009/058813 which has an International filing date of May 12, 2009 and designated the United States of America.

BACKGROUND

1. Technical Field

The present invention relates to a dust core and a choke used in a PFC circuit employed in a home appliance such as a TV or an air conditioner, and more particularly, it relates to a dust core and a choke obtained through compaction of a soft magnetic Fe-based amorphous alloy powder.

2. Description of Related Art

An initial stage part of a power circuit for a home appliance includes an AC/DC converter circuit for converting an AC (alternating current) voltage to a DC (direct current) voltage. It is known in general that the waveform of an input current to the converter circuit is shifted in the phase from a voltage waveform or that there arises a phenomenon that the current waveform itself is not a sine wave. Therefore, what is called a power factor is lowered so as to increase reactive power, and harmonic noise is caused. The PFC circuit controls such a shifted waveform of the AC input current to be rectified into a phase or a waveform similar to that of the AC input voltage, so as to reduce the reactive power and the harmonic noise.

Recently, it has been decided by law, under the control of IEC (International Electro-technical Commission), that a PFC-controlled power circuit is indispensable in various equipment.

In order to reduce the size and the height of a choke used in the PFC circuit, there are demands on the material for a core for having characteristics of a high saturation magnetic flux density Bs and a small core loss Pcv as well as satisfactory DC superposed characteristics.

In consideration of these demands, a dust core made of a magnetic powder of a metal such as Sendust or a Fe—Si-based metal is regarded to be well-balanced and is employed.

Japanese Patent Application Laid-Open No. 2005-57230 proposes a core using a metal powder obtained through pulverization of a Fe-based amorphous alloy ribbon for further reducing the core loss.

Furthermore, Japanese Patent Application Laid-Open No. 2002-249802 proposes a mixture of a plate powder obtained through pulverization of an amorphous alloy ribbon and a spherical powder obtained by an atomization method for improving the density of a molded body.

SUMMARY

The present inventor has examined the conditions for pulverizing a Fe-based amorphous alloy ribbon with reference to Japanese Patent Application Laid-Open No. 2005-57230. A method in which the ribbon is stiffened through a heat treatment before pulverization as described in Japanese Patent Application Laid-Open No. 2005-57230 is effective and the efficiency in the pulverization is effectively high, but an actually obtained core cannot attain an expected low core loss and has a problem of inferiority to the Sendust and a Fe—Si-based dust.

Japanese Patent Application Laid-Open No. 2002-249802 describes that compaction may be easily attained by mixing an amorphous spherical powder obtained by the atomization method and an amorphous flake powder obtained through pulverization of a quenched ribbon and proposes a dust core improved in the compaction density. However, the present inventor has found, through an attempt, a problem that the compaction density is minimally improved when the spherical powder and the flake powder have substantially the same diameter as described in Japanese Patent Application Laid-Open No. 2002-249802.

Accordingly, in consideration of the aforementioned problems, an object of the present invention is providing, even by using a pulverized powder of a Fe-based amorphous alloy ribbon, a dust core having a low core loss, satisfactory DC superposed characteristics, and a high density and high strength of a molded body, and a choke.

The present inventor has studied the form and the grain size of a pulverized powder in order to realize, even in a pulverized powder, a low core loss and satisfactory DC superposed characteristics, that is, the merits of a Fe-based amorphous alloy ribbon, resulting in finding the following: When a pulverized powder is in the form of a thin plate with two principal planes opposing each other and has a minimum value of the grain size along the direction of the principal plane more than twice and not more than six times as large as the thickness of the pulverized powder, and a Cr-containing Fe-based amorphous atomized spherical powder with a grain size not more than a half of the thickness of the pulverized powder and not less than 3 μm is mixed with the pulverized powder for attaining a high density of a molded body, a good dust core having both a low core loss and satisfactory DC superposed characteristics may be obtained and a choke may be fabricated by forming a coil by winding a conductor wire around the dust core by several times.

Specifically, the present invention provides a dust core including, as principal components, a pulverized powder of an Fe-based amorphous alloy ribbon corresponding to a first magnetic body; and a Cr-containing Fe-based amorphous alloy atomized spherical powder corresponding to a second magnetic body, and the pulverized powder is in the shape of a thin plate having two principal planes opposing each other, and assuming that a minimum dimension along a plane direction of the principal planes is a grain size, the pulverized powder includes a pulverized powder with a grain size more than twice and not more than six times as large as a thickness of the pulverized powder in a proportion of 80 mass % or more of the whole pulverized powder and includes a pulverized powder with a grain size not more than twice as large as the thickness of the pulverized powder in a portion of 20 mass % or less of the whole pulverized powder, and the atomized spherical powder has a grain size not more than a half of the thickness of the pulverized powder and not less than 3 μm.

Furthermore, in the dust core, a mixing ratio of the pulverized powder of the Fe-based amorphous alloy ribbon corresponding to the first magnetic body and the Cr-containing Fe-based amorphous alloy atomized spherical powder corresponding to the second magnetic body is 95:5 through 75:25 in a mass ratio.

Moreover, in the dust core, a core loss at a frequency of 50 kHz and a magnetic flux density of 50 mT is 70 $kW/m^3$ or less and relative permeability in a magnetic field of 10000 A/m is 30 or more.

Furthermore, the dust core further includes an epoxy resin coated on a surface thereof after coating the surface with silicone rubber.

Alternatively, the present invention provides a choke formed as a coil by winding a conductor wire around the dust core described above by several times.

Alternatively, the present invention provides a choke including the dust core housed in a resin case and fixed on an inside of the resin case with silicone rubber, and formed as a coil by winding a conductor wire around an outer face of the resin case by several times.

According to the present invention, degradation of the characteristics of an Fe-based amorphous alloy ribbon, that is, a low loss and satisfactory DC superposed characteristics, caused through pulverization may be suppressed to be minimum. Furthermore, the invention provides a dust core that may be molded into a free shape through press molding and has high strength, and a choke.

The above and further objects and features will more fully be apparent from the following detailed description with accompanying drawings.

DETAILED DESCRIPTION

Figure 1:
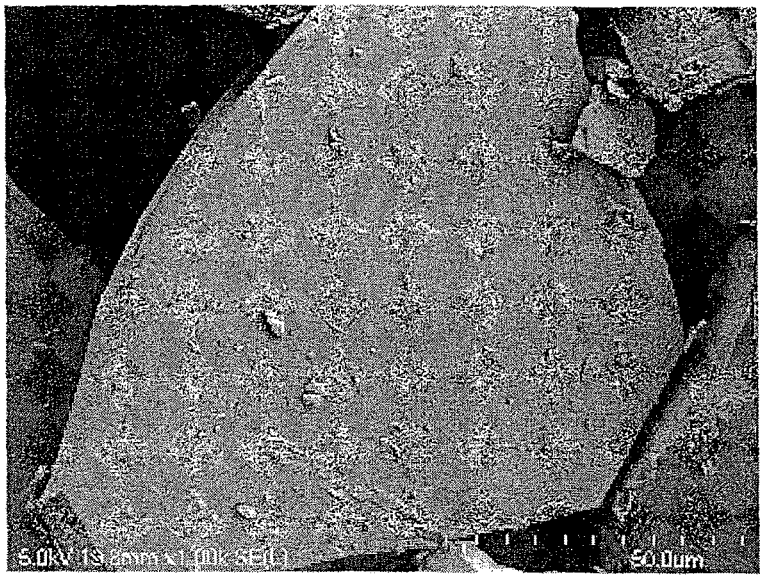
FIG. 1 is an SEM image of an Fe-based amorphous ribbon pulverized powder with a grain size more than 50 μm according to the present invention.

The present invention provides a dust core including, as principal components, a pulverized powder of an Fe-based amorphous alloy ribbon corresponding to a first magnetic body; and a Cr-containing Fe-based amorphous alloy atomized spherical powder corresponding to a second magnetic body, and the pulverized powder is in the shape of a thin plate having two principal planes opposing each other, and assuming that a minimum dimension along a plane direction of the principal planes is a grain size, the pulverized powder includes a pulverized powder with a grain size more than twice and not more than six times as large as a thickness of the pulverized powder in a proportion of 80 mass % or more of the whole pulverized powder and includes a pulverized powder with a grain size not more than twice as large as the thickness of the pulverized powder in a portion of 20 mass % or less of the whole pulverized powder, and the atomized spherical powder has a grain size not more than a half of the thickness of the pulverized powder and not less than 3 μm.

Furthermore, in the dust core, a mixing ratio of the pulverized powder of the Fe-based amorphous alloy ribbon corresponding to the first magnetic body and the Cr-containing Fe-based amorphous alloy atomized spherical powder corresponding to the second magnetic body is 95:5 through 75:25 in a mass ratio.

Moreover, in the dust core, a core loss at a frequency of 50 kHz and a magnetic flux density of 50 mT is 70 kW/m$^3$ or less and relative permeability in a magnetic field of 10000 A/m is 30 or more.

Furthermore, the dust core further includes an epoxy resin coated on a surface thereof after coating the surface with silicone rubber.

Alternatively, the present invention provides a choke formed as a coil by winding a conductor wire around the dust core described above by several times.

Alternatively, the present invention provides a choke including the dust core housed in a resin case and fixed on an inside of the resin case with silicone rubber, and formed as a coil by winding a conductor wire around an outer face of the resin case by several times.

With respect to the problem that although an Fe-based amorphous alloy ribbon has merits of a low loss and satisfactory DC superposed characteristics, the magnetic characteristics are degraded through pulverization, the present inventor has studied minimization of the degradation caused through the pulverization. Furthermore, the present inventor has studied a dust core that may be molded into a comparatively free shape.

(Stiffening Heat Treatment)

An Fe-based amorphous alloy ribbon has a property that it is stiffened through a heat treatment of 300° C. or more so as to be easily pulverized. When the treatment is performed at a higher temperature, it is more stiffened and is more easily pulverized. However, when the temperature exceeds 380° C., the core loss is increased. Therefore, the heat treatment is performed preferably at a temperature of 320° C. or more and 370° C. or less.

(Preliminary Study)

First, an Fe-based amorphous alloy ribbon (with a thickness of 25 μm) having been stiffened through a heat treatment at 360° C. was pulverized with an impact mill, and a pulverized powder having passed through a sieve with an opening of 106 μm was used for fabricating a core (a dust core). An acrylic organic binder was added to the pulverized powder, Sb-based low-melting glass was further added thereto as an inorganic binder, and the resultant powder was molded into a ring shape with a pressure of 2 GPa by using a 37-ton pressing machine. Next, a heat treatment was performed at 400° C. for removing strain derived from the pulverization of the pulverized powder and for insulating and binding particles of the pulverized powder by the inorganic binder. Through this heat treatment, the organic binder disappears through thermal decomposition. A conductor wire was wound around the core with an insulating film sandwiched therebetween, so as to form a coil. When the core loss was measured, a large values of 115 kW/m$^3$ and 249 kW/m$^3$ were obtained at a magnetic flux density of 50 mT respectively at frequencies of 50 kHz and 100 kHz (Comparative Example 3).

(Fe-Based Amorphous Alloy Ribbon Pulverized Powder)

Figure 3:
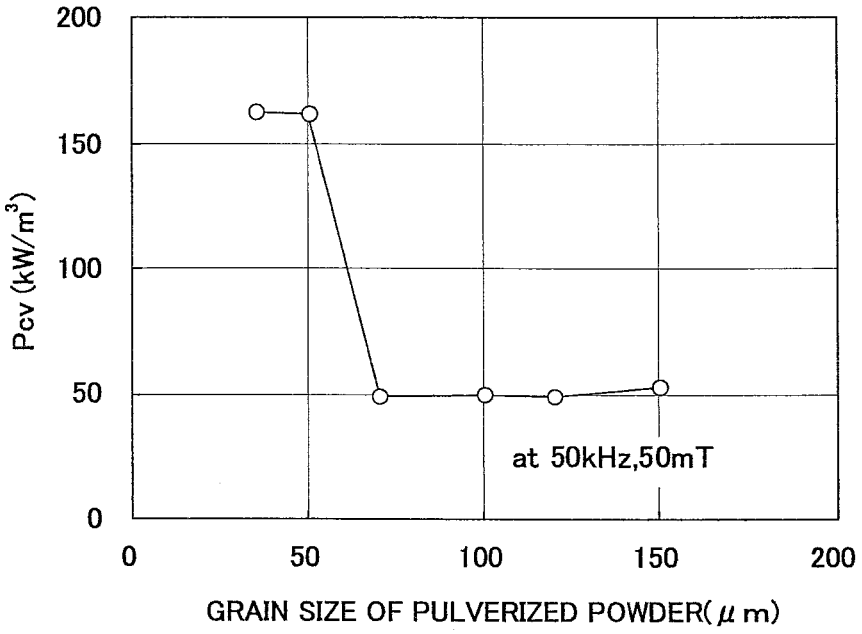
FIG. 3 is a graph illustrating the relationship between a grain size of a pulverized powder and a core loss.

Therefore, in order to find the cause of the large value of the core loss, the pulverized powder having passed through the sieve with an opening of 106 μm was classified by using a sieve with a smaller opening, so as to check the core loss by using a grain size of the pulverized powder as a parameter. The result is illustrated in FIG. 3. At this point, the grain size of a pulverized powder is a numerical value obtained by multiplying the opening of a sieve by 1.4 and is substantially equal to the minimum dimension along the plane direction of the principal planes of the powder pulverized into a shape of a thin plate.

Figure 8:
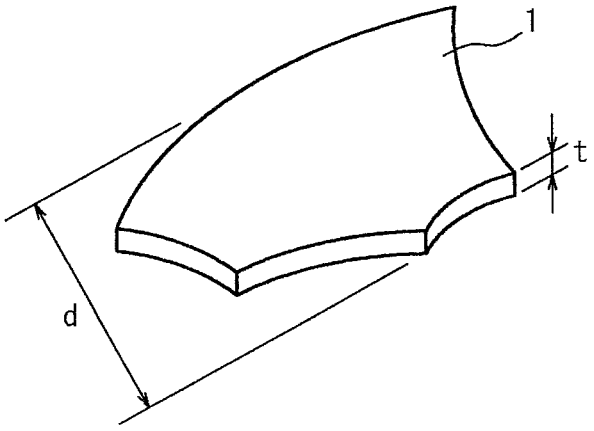
FIG. 8 is an explanatory diagram of a grain size of the Fe-based amorphous ribbon pulverized powder.

This will be described with reference to an example illustrated in FIG. 8. A grain size of an Fe-based amorphous alloy ribbon pulverized powder 1 corresponds to a minimum dimension d along the plane direction of the principal planes. In this drawing, "t" corresponds to the thickness of the Fe-based amorphous alloy ribbon.

The grain size of the pulverized powder is a numerical value controlled in accordance with the opening of a sieve, and substantially accords with a numerical value observed/measured with a scanning electron microscope (hereinafter referred to as the SEM).

Figure 2:
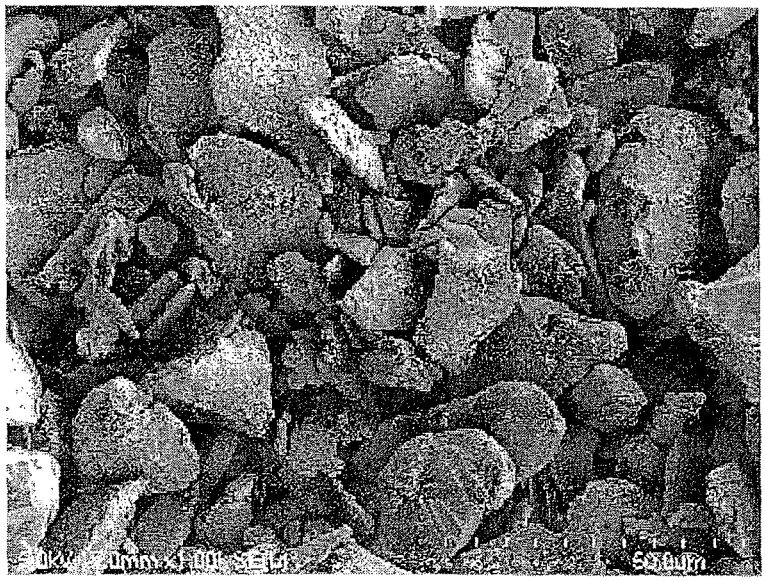
FIG. 2 RELATED ART
FIG. 2 is an SEM image of an Fe-based amorphous ribbon pulverized powder with a grain size not more than 50 μm according to Comparative Example 1.

It is understood from FIG. 3 that the core loss is abruptly increased in a powder with a grain size not more than 50 μm (twice as large as the thickness of the ribbon). Accordingly, when a pulverized powder with a grain size not more than 50 μm (twice as large as the thickness of the ribbon) is included, the core loss seems to be increased. Furthermore, the shapes of pulverized powders with various grain sizes were observed with the SEM. As a result, in a pulverized powder with a grain size more than 50 μm having a core loss with a small value, traces of the processing were unclear on two principal planes of the pulverized powder corresponding to the two principal planes of the amorphous ribbon prior to the pulverization as illustrated in FIG. 1. Furthermore, the ends of the two principal planes were clearly observed as edges. On the other hand, in a pulverized powder with a grain size not more than 50 μm, shapes clearly scraped off through the processing were observed also on the two principal planes as a result of the pulverization as illustrated in FIG. 2, and edges of the ends of the two principal planes were not clear.

Figure 6:
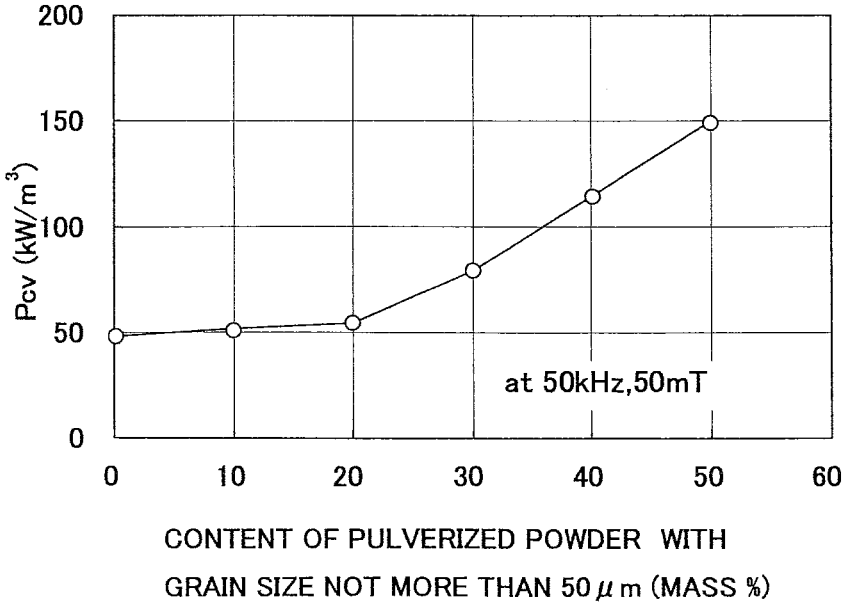
FIG. 6 is a graph illustrating the relationship between a content of a pulverized powder with a grain size not more than 50 μm and a core loss.

Next, examination was made on the content of the pulverized powder with a grain size not more than 50 μm (twice as large as the thickness of the ribbon) that particularly degrades the core loss. A pulverized powder having passed through a sieve with an opening of 35 μm (corresponding to a grain size of 49 μm) was mixed with a pulverized powder with a grain size more than 50 μm and not more than 150 μm, so as to study the influence on the core loss of the pulverized powder with a grain size not more than 50 μm. The result is illustrated in FIG. 6. It is understood that the core loss is minimally degraded as far as the content of the pulverized powder with a grain size not more than 50 μm is 20 mass % or less.

Specifically, there is no fear of increase of the core loss as far as the content of the pulverized powder with a grain size not more than 50 μm is 20 mass % or less.

As a result of the measurement and the observation with the SEM described above, the following was found: In pulverization of an Fe-based amorphous alloy ribbon (with a thickness of 25 μm), when the pulverization is performed with traces of the processing unclearly left on the two principal planes of the Fe-based amorphous alloy ribbon prior to the pulverization (i.e., when the grain size is more than 50 μm), the merit of the low core loss may be kept, but the pulverization is performed with traces clearly left at least on the two principal planes including the end edges of the two principal planes (i.e., when the grain size is not more than 50 μm), the core loss is largely increased. The core loss is thus largely increased probably because the strain derived from the pulverization caused over the two principal planes remains in the pulverized powder.

When an Fe-based amorphous alloy ribbon having been stiffened is pulverized, it may be presumed that principal planes are minimally pulverized as far as it is pulverized into a grain size more than twice as large as the thickness of the ribbon (i.e., a grain size more than 50 μm).

However, even when a pulverized powder clearly pulverized on the two principal planes (with a grain size not more than 50 μm) is included, the core loss is minimally degraded as far as the content is 20 mass % or less of the whole pulverized powder.

In press molding, a powder flows within a die so as to improve the mold density, resulting in obtaining a dense molded body, and a powder in the shape of a thin plate is inferior in the flow characteristics. Accordingly, when the grain size exceeds 150 μm (six times as large as the thickness of the ribbon), a dense molded body cannot be obtained. Therefore, the grain size of the pulverized powder is more preferably more than 50 μm (twice as large as the thickness of the ribbon) and not more than 150 μm (six times as large as the thickness of the ribbon).

It is noted that a pulverized powder may include a slight amount of a coarse pulverized powder with a grain size exceeding the classification range even after the classification with a sieve. In the present invention, even when a coarse pulverized powder with a grain size exceeding the aforementioned classification range is included, there arises no problem as far as the amount is minute.

(Fe Amorphous Alloy Spherical Powder)

Next, examination was made on improvement of the density of a molded body. As described above, the density could not be improved through mixture of the spherical powder with the grain size disclosed in Japanese Patent Application Laid-Open No. 2002-249802. The present inventor has made examination by using, as a parameter, a grain size of an Fe-amorphous alloy spherical powder obtained through a water atomization method. As a result, it was found that the density of a molded body is improved when the grain size is smaller than the thickness of the pulverized powder. This is probably for the following reason: A space formed in the vicinity of a pulverized face of the pulverized powder in the shape of a thin plate is minimally filled by pressing when the pulverized powder alone is used, but when a spherical powder with a grain size smaller than the thickness of the pulverized powder enters the space formed in the vicinity of the pulverized face, the packing density seems to be improved. Furthermore, the flow characteristics of the powder in the press molding seems to be improved by the spherical powder.

For improving the density, the grain size of the spherical powder is preferably 50% or less of the thickness of the pulverized powder in the shape of a thin plate. When the thickness of the ribbon is 25 μm, the grain size of the spherical powder is preferably 12.5 μm or less. When the grain size is smaller, the space may be more effectively filled, but when the grain size is too small, cohesive force of the spherical powder is so large that it is difficult to disperse the powder. Accordingly, the grain size is preferably 3 μm or more.

The grain size of the spherical powder corresponds to a median diameter D50 (i.e., a grain size corresponding to cumulative 50 mass %) measured through a laser diffraction scattering method, and substantially accords with a numerical value observed/measured with an SEM similarly to that of the Fe-based amorphous alloy ribbon pulverized powder.

Incidentally, as the grain size of the Fe-based spherical powder is smaller, the surface area is larger, and hence there arises a problem of oxidation caused by an atmosphere of vapor or the like in the fabrication of a core. This problem may be overcome by employing, as the composition of the spherical powder, a Cr-containing Fe-based amorphous alloy atomized spherical powder.

(Mixing Ratio Between Pulverized Powder and Spherical Powder)

With respect to a mixing ratio between the pulverized powder and the spherical powder, when the spherical powder is present in a mass ratio of 95:5 or more, the effect to improve the density of a molded body is clearly exhibited, and the density is improved up to a mass ratio of 75:25. Even when the content of the spherical powder is increased beyond this mass ratio, the density of a molded body is not improved. This is probably because the aforementioned effect to fill the space is lost. Accordingly, the mixing ratio of the spherical powder is preferably 5 mass % or more and 25 mass % or less (Examples 9, 10 and 11 and Comparative Examples 5 and 6).

(Organic Binder and Inorganic Binder)

In the press molding of a mixed powder of the pulverized powder and the spherical powder, it is necessary to use an organic binder for binding particles of the powders at room temperature.

Furthermore, in order to remove the strain derived from the pulverization, it is necessary to perform a heat treatment at 400° C. for 1 hour after the molding. Through this heat treatment, the organic binder disappears through thermal decomposition. Accordingly, when the organic binder alone is used, the binding force between the particles of the pulverized powder and the spherical powder minimally remains after the heat treatment, and hence, the strength of the molded body is also lost.

Therefore, an inorganic binder is added together with the organic binder for binding the particles of the powders even when the temperature is lowered to room temperature after the heat treatment of approximately 400° C. The inorganic binder starts to exhibit the flow characteristics in a temperature region where the organic binder is thermally decomposed, so as to spread over the surfaces of the powders and bind the powders. Furthermore, the inorganic binder provided on the surfaces of the powders simultaneously provides insulation more definitely through the capillarity caused between the particles of the powders. The binding force and the insulating property are kept even after the temperature is lowered to room temperature.

The organic binder is preferably selected so as to keep the binding force between the particles of the powders for preventing occurrence of chip and crack in the molded body during the molding processing and preparation for the heat treatment and to easily thermally decompose in the heat treatment performed after the molding. As a binder that is substantially completely thermally decomposed at a temperature of 400° C., an acrylic resin is preferably used.

As the inorganic binder, low-melting glass that may attain the flow characteristics at a comparatively low temperature or a silicone resin good at the heat resistance and the insulating property is preferably used. As the silicone resin, a methyl silicone resin or a phenyl methyl silicone resin is more preferably used.

The content of the inorganic binder to be added is determined in accordance with the flow characteristics of the inorganic binder and the wettability and the adhesion with the surfaces of the powders, the surface area of the metal powders and the mechanical strength required of the core to be attained after the heat treatment, and the core loss to be attained. When the content of the inorganic binder is increased, although the mechanical strength of the core is increased, the stress caused in the pulverized powder and the spherical powder is also simultaneously increased. Therefore, the core loss is also increased. Accordingly, there is a trade-off relationship between a low core loss and high mechanical strength. The content is appropriately determined in consideration of a core loss and mechanical strength desired.

(Mixture of Pulverized Powder, Spherical Powder and the Like)

For mixing the pulverized powder, the spherical powder, the organic binder and the inorganic binder, a dry stirring/mixing machine is used. Furthermore, in order to reduce abrasion caused between the powders and the die during the press molding, 1 mass % or less of stearic acid or stearate such as zinc stearate is preferably added.

(Granulation)

Owing to an organic solvent included in the organic binder, the mixed powder has become an agglomerate powder with a wide size distribution in the mixing processing. When the powder is allowed to pass through a sieve with an opening of 425 μm by using a shaking sieve, a granulated powder is obtained.

(Molding)

The press molding is carried out by using a die for molding. The powder may be molded at a pressure not less than 1 GPa and not more than 3 GPa with holding time of several seconds. The pressure and the holding time are appropriately determined in accordance with the content of the organic binder and necessary strength of a molded body.

(Heat Treatment after Molding)

In order to attain high soft magnetic characteristics, it is necessary to reduce stress strain caused in the above-mentioned pulverizing processing and molding processing. When the relationship between a core loss and a heat treatment temperature is examined, the effect to reduce the stress strain is largely exhibited when the temperature is 350° C. or more and 420° C. or less, and thus, a low core loss may be attained.

When the temperature is lower than 350° C., the stress is insufficiently reduced, and when the temperature exceeds 420° C., partial crystallization of the pulverized powder starts, and hence, the core loss is largely increased. Accordingly, the temperature is preferably 350° C. or more and 420° C. or less. Furthermore, in order to stably attain a low core loss characteristic, the temperature is more preferably 380° C. or more and 410° C. or less.

At this point, a crystallization temperature will be described. The crystallization temperature may be determined by measuring a heat generating behavior with a differential scanning calorimeter (DSC). In each example described later, as the Fe-based amorphous alloy ribbon, 2605SA1 manufactured by Metglas is used. The crystallization temperature of this alloy ribbon is 510° C., which is higher than the crystallization temperature of the pulverized powder, that is, 420° C.

This is probably because the crystallization starts in the pulverized powder at a lower temperature than the crystallization temperature inherent to the alloy ribbon due to the stress caused in the pulverization.

(Insulation Coating of Core)

In general, a metal core with a conducting property is subjected to insulating processing such as resin coating on its surface, so that sufficient insulation may be secured from a conductor wire to be wound around it for preventing a short-circuit otherwise caused through the core in use. As another method for insulation, the core is housed in a resin case with a conductor wire wound around the outer face of the case. For attaining compactness, the insulation processing employing the resin coating is preferred, and for attaining high insulating reliability, the housing in the resin case is preferred.

When the present inventor tried epoxy resin coating by using a fluid bed at first, a phenomenon that the characteristics were degraded after the coating as compared with those attained before (without) the coating was observed. The reason is presumed to be because stress was caused in the core in solidification of the epoxy resin so as to degrade the magnetic characteristics. Therefore, a possibility that the degradation of the magnetic characteristics may be avoided by using a resin or the like causing smaller stress in the core was examined. As a result, it was found that the magnetic characteristics are minimally degraded by employing silicone rubber coating.

When a conductor wire is directly wound around the silicon rubber coating, however, the silicone rubber elastically deforms, so that it may be difficult to uniformly wind the conductor wire, and therefore, when coating with an epoxy resin or the like is further applied on the silicone rubber coating, the conductor wire may be uniformly wound on the epoxy resin coating while avoiding the degradation of the magnetic characteristics.

It is noted that the degradation of the magnetic characteristics caused by the epoxy resin coating is less observed as the size of the core is increased. This is probably for the following reason: When the ratio of the surface area of the core to the volume of the core is smaller, a volume ratio, to the whole volume of the core, of a portion in the vicinity of the surface of the core in which the stress is caused is reduced, and therefore, the degradation is not substantially observed. With respect to the ratio between the surface area of the core and the volume of the core, when a value of the surface area of the core/the volume of the core is 0.7 or more, the silicone coating exhibits an effect to prevent the degradation, and when the value is 0.9 or more, the effect is remarkably exhibited.

(Insulation of Core with Resin Case)

As described above, the core is housed in the resin case for securing high insulating reliability. When the core is housed in the resin case, the resin case is fabricated so as to have an inner dimension slightly larger than the outer dimension of the core for preventing stress caused in the core. Furthermore, if the core moves within the case, noise may be caused in use, and therefore, it is necessary to fix the core on the inner face of the case through adhesion. As a fixing method, adhesion with the silicone rubber that causes small stress in the core as described above is preferably used. Furthermore, since the core should be fixed inside the case within the limits of assumed impact, there is no need to adhere the core on its whole surface to the inner face of the case but the area and the position for the adhesion may be determined in consideration of estimated impact resistance.

(Fe-Based Amorphous Alloy Ribbon)

The Fe-based amorphous alloy ribbon will now be described.

The Fe-based amorphous alloy ribbon preferably has an alloy composition represented by $Fe_aSi_bB_cC_dM_e$ (wherein M is one or more elements selected from the group consisting of Cr, Mo, Mn, Zr and Hf; and a, b, c, d and e are atomic percentages satisfying relationships of $50 \le a \le 90$, $5 \le b \le 30$, $2 \le c \le 15$, $0 \le d \le 3$, $0 \le e \le 10$ and $a+b+c+d+e=100$).

The content a of Fe is preferably 60% or more and 80% or less in atomic percentage. When it is lower than 50 atm % (hereinafter atm % is simply expressed as %), corrosion resistance is lowered, and hence, it is impossible to obtain a dust core for use in an antenna good at long-term stability. Alternatively, when it exceeds 90%, the contents of Si and B described later are insufficient, and hence, it is industrially difficult to obtain an amorphous alloy ribbon. As far as the content a of Fe is not less than 50 atm %, 10% or less of the Fe may be replaced with one or two of Co and Ni. The contents of the Co and Ni are more preferably not more than 5% of the content of the Fe.

Si is indispensable as an element contributing to amorphous substance forming ability, and the content b of Si to be added is 5% or more. In order to improve the saturation magnetic flux density, however, the content should be 30% or less.

B is indispensable as an element contributing the most to the amorphous substance forming ability. When the content c of B is less than 2%, the thermal stability is lowered, and when it is more than 15%, an effect to improve the amorphous substance forming ability and the like cannot be exhibited even though B is added.

M is an effective element for improving the soft magnetic characteristics. The content e of M is preferably 8% or less, and when it exceeds 10%, the saturation magnetic flux density is lowered.

C has an effect to improve the squareness and the saturation magnetic flux density, and hence, C may be included as far as the content d of C is 3% or less as a whole. When the content exceeds 3%, the stiffening property and the thermal stability are lowered.

Furthermore, assuming that the aforementioned alloy composition is 100%, at least one or more elements selected from the group consisting of S, P, Sn, Cu, Al and Ti may be present as unavoidable impurities in a ratio of 0.5% or less.

EXAMPLES

The present invention will now be described in detail on the basis of examples.

Example 1

As the Fe-based amorphous alloy ribbon, a material of 2605SA1 manufactured by Metglas with an average thickness of 25 μm and a width of 213 mm was used. The Fe-based amorphous alloy ribbon was wound in a coreless manner into a weight of 10 kg. The wound ribbon was heated in an oven under a dry air atmosphere at 360° C. for 2 hours for stiffening. After cooling the wound ribbon taken out of the oven, it was pulverized with an impact mill manufactured by Dalton Co., Ltd. (with throughput capacity of 20 kg/h. and a speed of rotation of 18000 rpm). The thus obtained pulverized powder was allowed to pass through a sieve with an opening of 106 μm (corresponding to a grain size of 149 μm). Approximately 70 mass % of the powder passed through the sieve. Furthermore, a part of the pulverized powder passing through a sieve with an opening of 35 μm (corresponding to a grain size of 49 μm) was removed. The resultant pulverized powder that had passed through the sieve with an opening of 106 μm but had not passed through the sieve with an opening of 35 μm was observed with an SEM. In the powder having passed through the sieve, traces of the processing were minimally observed on the two principal planes of the alloy ribbon prior to the pulverization. The edges at the ends of the two principal planes were clear. The shapes of the two principal planes were amorphous, and the minimum grain size was 50 μm through 150 μm, which corresponds to numerical values obtained by multiplying the openings of the sieves by approximately 1.4.

To 80 g of the thus obtained pulverized powder, 20 g (corresponding to a content of 20 mass %) of $Fe_{74}B_{11}Si_{11}C_2Cr_2$ (with a grain size of 5 μm) manufactured by Epson Atmix Corporation was added as a Cr-containing Fe-based amorphous alloy atomized spherical powder, so as to give 100 g of the powder in total, and 2.0 g (corresponding to a content of 2 mass %) of VY0007M1 manufactured by Nippon Frit Co., Ltd., that is, Sb-based low-melting glass, working as the inorganic binder, 1.5 g (corresponding to a content of 1.5 mass %) of acrylic polysol AP-604 manufactured by Showa Highpolymer Co., Ltd. working as the organic binder and 0.5 g (corresponding to a content of 0.5 mass %) of zinc stearate were respectively weighed to be mixed with the powder with a versatile mixer manufactured by Dalton Co., Ltd.

The thus obtained mixed powder was allowed to pass through a sieve with an opening of 425 μm so as to give a granulated powder. The granulated powder was subjected to the press molding by using a 37-ton pressing machine with a pressure of 2 GPa and holding time of 2 seconds into a toroidal shape with an outside dimension of an outer diameter of 14 mm, an inner diameter of 7.5 mm and a height of 5.5 mm.

The thus obtained molded body was subjected to a heat treatment with an oven in an air atmosphere at 400° C. for 1 hour, and thereafter, the resultant was coated with a silicone rubber coating material KE-4895 manufactured by Shinetsu Silicone Co., Ltd. by the dipping method, and the coating was dried and solidified at 120° C. for 1 hour, so as to obtain a silicone rubber-coated substance. The thickness of the coating was approximately 50 μm, which was obtained through measurement with a micrometer before and after the coating. Furthermore, an epoxy resin, Epiform, manufactured by Somar Corporation was applied by a powder flowing method and solidified at 170° C., so as to obtain an epoxy resin-coated substance. The thickness measured in the same manner as described above was 100 μm through 300 μm.

An insulating coated conductor wire with a diameter of 0.25 mm was wound, by 20 times, around each of two toroidal cores fabricated as described, so as to fabricate a pair of coils. The core losses of the coils, which were measured with B-H analyzer SY-8232 manufactured by Iwatsu Test Instruments Corporation at a magnetic flux density of 50 mT and frequencies of 50 kHz and 100 kHz, were 49 kW/m$^3$ and 119 kW/m$^3$, respectively.

Furthermore, as the DC superposed characteristics, an insulating coated conductor wire with a diameter of 0.6 mm was wound, by 30 times, around the toroidal core, and relative permeability μ, which was measured by using HP-4284A manufactured by Hewlett-Packard Development Company under conditions of 100 kHz and 1 V in a magnetic field H of 0, 5000 and 10000 A/m, was 65, 50 and 31, respectively. The results are listed in a row No. 1 (Example 1) of Table 1 below.

Comparative Example 1

A toroidal core was fabricated under the same conditions as in Example 1 except that Sendust (with a grain size D50 of 60 μm) was used instead of the Fe-based amorphous alloy ribbon pulverized powder, so as to examine the core loss and the DC superposed characteristics. The results are listed in a row No. 10 (Comparative Example 1) of Table 1. The core loss at a frequency of 50 kHz and a magnetic flux density of 50 mT was 85 kW/m$^3$ and the relative permeability in a magnetic field of 10000 A/m was 22.

Comparative Example 2

A toroidal core was fabricated under the same conditions as in Example 1 except that DAPMS7 (with a grain size D50 of 75 μm) manufactured by Daido Steel Co., Ltd., that is, a Fe—Si 6.5% powder, was used instead of the Fe-based amorphous alloy ribbon pulverized powder, so as to examine the core loss and the DC superposed characteristics. The results are listed in a row No. 11 (Comparative Example 2) of Table 1. The core loss at a frequency of 50 kHz and a magnetic flux density of 50 mT was 161 kW/m$^3$ and the relative permeability in a magnetic field of 10000 A/m was 38.

Figure 4:
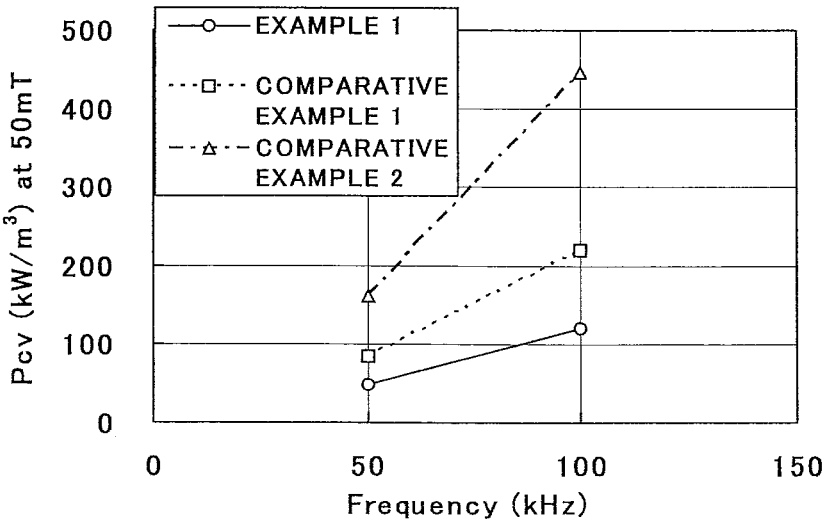
FIG. 4 is a graph illustrating the relationships between a frequency and a core loss obtained in the present invention and comparative examples.

FIG. 4 illustrates results of evaluation for the core loss-frequency characteristics of No. 1 (Example 1) of Table 1, No. 10 (Comparative Example 1) where Sendust (of Fe—Si-based) was used as the material for the powder and No. 11 (Comparative Example 2) where a Fe—Si-based material was used for the powder. The core loss of No. 1 (Example 1) is the lowest at frequencies of both 50 kHz and 100 kHz.

Figure 5:
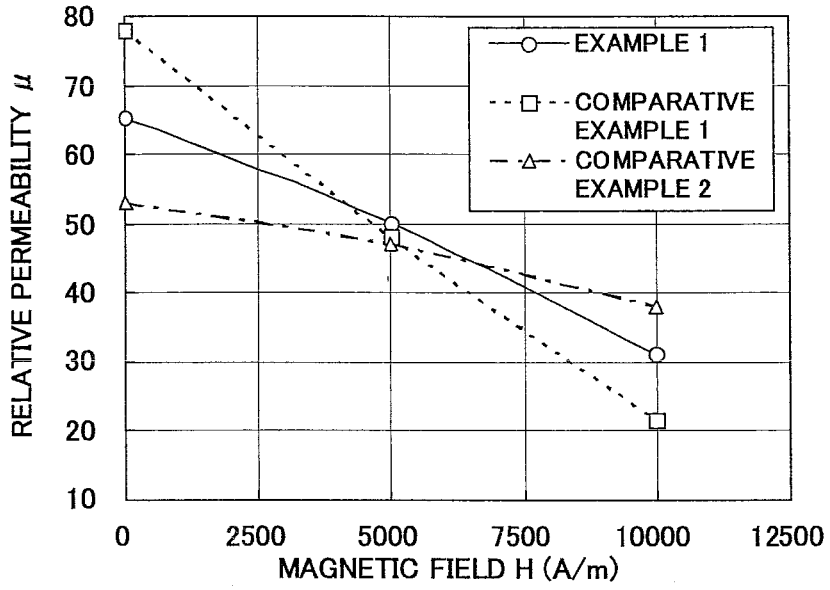
FIG. 5 is a graph illustrating the relationships between a magnetic field and relative permeability obtained in the present invention and the comparative examples.

Furthermore, FIG. 5 illustrates results of evaluation for the dependency of the magnetic permeability μ on the magnetic field H obtained by using the same samples as those described above. As a reducing rate of the magnetic permeability attained when H=5000 A/m or 10000 A/m to that attained when H=0 A/m is smaller, better DC superposed characteristics are exhibited, and No. 1 (Example 1) is inferior to No. 11 (Comparative Example 2) (using the Fe—Si-based material) but is much better than No. 10 (Comparative Example 1) (using the Sendust).

It is understood from these results that the core of Example 1 has a lower core loss than those of Comparative Examples 1 and 2 and has a better DC superposed characteristics than that of Comparative Example 1.

Example 2

A toroidal core was fabricated and evaluated under the same conditions as in Example 1 except that the grain size of the Cr-containing Fe-based amorphous alloy atomized spherical powder of $Fe_{74}B_{11}Si_{11}C_2Cr_2$ was 10 μm and that a toroidal shape with an outside dimension of an outer diameter of 30 mm, an inner diameter of 20 mm and a height of 8.5 mm was employed. The results are listed in a row No. 2 (Example 2) of Table 1. The toroidal core attained such good characteristics that the core loss at a frequency 50 kHz and a magnetic flux density of 50 mT was 53 kW/m$^3$ and the relative permeability in a magnetic field of 10000 A/m was 31.

Examples 3 and 4

Toroidal cores were fabricated and evaluated under the same conditions as in Example 1 except that a toroidal shape with an outside dimension of an outer diameter of 40 mm, an inner diameter of 23.5 mm and a height of 12.5 mm was employed. In Example 3, the epoxy resin coating was performed after the silicone rubber coating, and in Example 4, the epoxy resin coating alone was performed without performing the silicone rubber coating for comparative evaluation. Since the ratio of the core surface area/the core volume was as small as 4137/10281=approximately 0.40, a significant difference derived from the silicone rubber coating was not observed.

The results are listed in rows No. 3 (Example 3) and No. 4 (Example 4) of Table 1. These toroidal cores attained such good characteristics that the core losses at a frequency of 50 kHz and a magnetic flux density of 50 mT were respectively 44 kW/m$^3$ and 45 kW/m$^3$ and the relative permeability in a magnetic field of 10000 A/m was both 30.

Example 5

A toroidal core was fabricated and evaluated under the same conditions as in Example 1 except that the Sb low-melting glass used as the inorganic binder was replaced with Glass 60/200 manufactured by Nippon Electric Glass Co., Ltd. The results are listed in a row No. 5 (Example 5) of Table 1. The toroidal core attained such good characteristics that the core loss at a frequency of 50 kHz and a magnetic flux density of 50 mT was 55 kW/m$^3$ and the relative permeability in a magnetic field of 10000 A/m was 31.

Example 6

A toroidal core was fabricated and evaluated under the same conditions as in Example 1 except that the content of the Sb low-melting glass used as the inorganic binder, which was 2 mass % in Example 1, was changed to 5 mass %. The results are listed in a row No. 6 (Example 6) of Table 1. The core loss at a frequency of 50 kHz and a magnetic flux density of 50 mT was 66 kW/m$^3$, which is larger than that attained in Example 1, that is, 49 kW/m$^3$. Furthermore, the relative permeability in a magnetic field of 10000 A/m was 30, which is substantially the same as that attained in Example 1, that is, 31.

Figure 7:
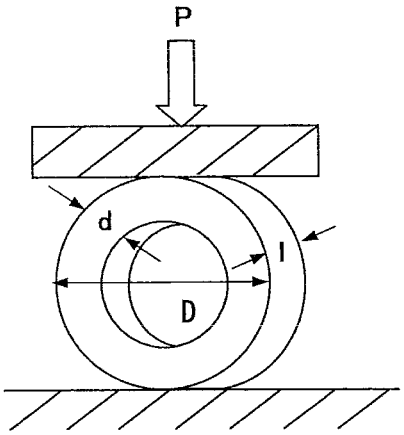
FIG. 7 is an explanatory diagram of an evaluation method for core radial crushing strength.

The cores were compared in the mechanical strength. On the basis of the maximum load P (N) applied in crushing a core obtained by an evaluation method illustrated in FIG. 7, radial crushing strength σr (MPa) was obtained in accordance with the following expression:

$$\sigma r = P(D-d)/Id^2$$

wherein D indicates the outer diameter (mm) of the core, d indicates the radial thickness (mm) of the core and I indicates the height (mm) of the core.

As a result, the strength of the core of Example 1 was 12 MPa and that of Example 6 was 25 MPa.

Thus, the following was confirmed: When the content of the inorganic binder is increased, although the mechanical strength of the core is increased, stress caused in the pulverized powder and the spherical powder is also increased, and hence, the core loss is increased. There is a trade-off relationship between a low core loss and high mechanical strength.

Example 7

A toroidal core was fabricated and evaluated under the same conditions as in Example 1 except that the Sb low-melting glass used as the inorganic binder was replaced with 1.0 g (corresponding to a content of 1 mass %) of SILRES H44 manufactured by Wacker Asahikasei Silicone Co., Ltd., that is, a phenyl methyl silicone resin. The results are listed in a row No. 7 (Example 7) of Table 1. The toroidal core attained such good characteristics that the core loss at a frequency of 50 kHz and a magnetic flux density of 50 mT was 55 kW/m$^3$ and the relative permeability in a magnetic field of 10000 A/m was 30.

Example 8

A toroidal core was fabricated and evaluated under the same conditions as in Example 1 except that the Sb low-melting glass was replaced with 0.8 g (corresponding to a content of 0.8 mass %) of SILRES MK manufacture by Wacker Asahikasei Silicone Co., Ltd., that is, a methyl silicate resin. The results are listed in a row No. 8 (Example 8) of Table 1. The toroidal core attained such good characteristics that the core loss at a frequency of 50 kHz and a magnetic flux density of 50 mT was 70 kW/m$^3$ and the relative permeability in a magnetic field of 10000 A/m was 30.

Comparative Example 3

A toroidal core was fabricated and evaluated under the same conditions as in Example 1 except that a part of the pulverized powder passing through a sieve with an opening of 32 μm (corresponding to a grain size of 45 μm) was not removed. When the resultant pulverized powder not passing through the sieve was classified by using a shaking sieve, the grain size was 20 μm or more and 150 μm or less. Furthermore, particles having a grain size not more than 50 μm occupies 40 mass % of the whole pulverized powder. The results are listed in a row No. 12 (Comparative Example 3) of Table 1. The core loss at a frequency of 50 kHz was as large as 115 kW/m$^3$ (see FIG. 6).

Comparative Example 4

A toroidal core was fabricated and evaluated under the same conditions as in Example 1 except that the epoxy coating alone was performed without performing the silicone rubber coating. The results are listed in a row No. 13 (Comparative Example 4) of Table 1. The core loss at a frequency of 50 kHz was as large as 90 kW/m$^3$. It is understood that since the ratio of the core surface area/the core volume is as large as 590/603=approximately 0.98, the core loss is largely degraded by the stress caused by the epoxy resin.

Examples 9, 10 and 11 and Comparative Examples 5 and 6

Toroidal cores were fabricated under the same conditions as in Example 1 except that the mixing ratio between the pulverized powder and the spherical powder was changed respectively to 100:0, 95:5, 85:15, 75:25 and 70:30, so as to evaluate the density of molded bodies. The results are listed in Table 2 together with the result attained by the core of Example 1. The density is improved when the ratio of the spherical powder is 5% or more, 15% and 25%. The density attained when the ratio is 30% is, however, equivalent to that attained when the ratio is 25%.

Example 12

A molded body of a core fabricated under the conditions of Example 1 and having been subjected to a heat treatment at 400° C. for 1 hour was housed in a glass-reinforced PET resin case manufactured by Du Pont Kabushiki Kaisha with an outside dimension of an outer diameter of 15 mm, an inner diameter of 6.5 mm, a height of 6.5 mm and a thickness of 0.6 mm, silicone rubber was injected into six portions positioned at equal intervals on the inner face of an outer circumferential part of the resin case opposing the outer circumferential face of the core, and silicone rubber was similarly injected into six portions positioned on the inner face of an inner circumferential part of the resin case opposing the inner circumferential face of the core. A ring-shaped cover is adhered onto the resin case with an epoxy adhesive, so as to fabricate a toroidal core. A conductor wire was wound around the thus obtained core in the same manner as in Example 1 for evaluation. The results are listed in a row No. 9 (Example 12) of Table 1. The core attained such good characteristics that the core loss at a frequency of 50 kHz and a magnetic flux density of 50 mT was 48 kW/m$^3$ and the relative permeability in a magnetic field of 10000 A/m was 31.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

TABLE 2-continued

| No. | | Pulverized Powder Mass % | Spherical Powder Mass % | Density of Molded Body (kg/m$^3$) | Ratio assuming No. 17 (Comparative Example 5) as 100 |
|---|---|---|---|---|---|
| 15 | Example 10 | 85 | 15 | 5.67 × 10$^3$ | 102.2 |
| 16 | Example 11 | 75 | 25 | 5.70 × 10$^3$ | 102.7 |
| 17 | Com. Example 5 | 100 | 0 | 5.55 × 10$^3$ | 100.0 |
| 18 | Com. Example 6 | 70 | 30 | 5.70 × 10$^3$ | 102.7 |

TABLE 1

| No. | | Shape: Outer diameter × Inner diameter × Height(mm) | Grain size of pulverized powder (μm) | Grain size D50 of spherical powder (μm) | Silicone rubber coating | Core loss Pcv (kW/m$^3$) 50 kHz | 100 kHz | Permeability μ 0 A/m | 5000 A/m | 10000 A/m |
|---|---|---|---|---|---|---|---|---|---|---|
| 1 | Example 1 | 14 × 7.5 × 5.5 | 50-150 | 5 | Coated | 49 | 119 | 65 | 50 | 31 |
| 2 | Example 2 | 30 × 20 × 8.5 | 50-150 | 10 | Coated | 53 | 127 | 62 | 48 | 31 |
| 3 | Example 3 | 40 × 23.5 × 12.5 | 50-150 | 5 | Coated | 44 | 106 | 55 | 46 | 30 |
| 4 | Example 4 | 40 × 23.5 × 12.5 | 50-150 | 5 | Not coated | 45 | 108 | 56 | 46 | 30 |
| 5 | Example 5 | 14 × 7.5 × 5.5 | 50-150 | 5 | Coated | 55 | 122 | 63 | 49 | 31 |
| 6 | Example 6 | 14 × 7.5 × 5.5 | 50-150 | 5 | Coated | 66 | 173 | 54 | 45 | 30 |
| 7 | Example 7 | 14 × 7.5 × 5.5 | 50-150 | 5 | Coated | 55 | 140 | 58 | 47 | 30 |
| 8 | Example 8 | 14 × 7.5 × 5.5 | 50-150 | 5 | Coated | 70 | 179 | 59 | 47 | 30 |
| 9 | Example 12 | 15 × 8.5 × 6.5 | 50-150 | 5 | Not coated (resin case) | 48 | 116 | 64 | 49 | 31 |
| 10 | Com. Example 1 | 14 × 7.5 × 5.5 | D50 = 60 (Sendust) | 5 | Coated | 85 | 220 | 78 | 48 | 22 |
| 11 | Com. Example 2 | 14 × 7.5 × 5.5 | D50 = 75 (Fe—Si) | 5 | Coated | 161 | 447 | 53 | 47 | 38 |
| 12 | Com. Example 3 | 14 × 7.5 × 5.5 | 20-150 | 5 | Coated | 115 | 249 | 48 | 40 | 30 |
| 13 | Com. Example 4 | 14 × 7.5 × 5.5 | 50-150 | 5 | Not coated | 90 | 229 | 54 | 41 | 27 |

TABLE 2

| No. | | Pulverized Powder Mass % | Spherical Powder Mass % | Density of Molded Body (kg/m$^3$) | Ratio assuming No. 17 (Comparative Example 5) as 100 |
|---|---|---|---|---|---|
| 1 | Example 1 | 80 | 20 | 5.69 × 10$^3$ | 102.5 |
| 14 | Example 9 | 95 | 5 | 5.60 × 10$^3$ | 100.9 |

The invention claimed is:

1. A dust core comprising, as principal components:

a pulverized powder of an Fe-based amorphous alloy ribbon corresponding to a first magnetic body; and a Cr-containing Fe-based amorphous alloy atomized spherical powder corresponding to a second magnetic body, wherein a mixing ratio of the pulverized powder to the atomized spherical powder is 95:5 through, but not including, 90:10 in a mass ratio, wherein the pulverized powder and the atomized spherical powder are bound by a high-temperature binder, wherein the pulverized powder is in the shape of a thin plate having two principal planes opposing each other and ends of the two principal planes include edges, wherein the pulverized powder passes through a sieve with an opening of 106 μm and does not pass through a sieve with an opening of 35 μm, wherein a minimum dimension along a plane direction of the principal planes in the pulverized powder is a grain size, the grain size of the pulverized powder is more than 50 μm and not more than 150 μm and is more than twice and not more than six times as large as a thickness of the Fe-based amorphous ahoy ribbon in a proportion of 80 mass % or more of the whole pulverized powder, wherein the atomized spherical powder has a grain size defined by a median diameter D50 not more than a half of the thickness of the Fe-based amorphous alloy ribbon and not less than 3 μm and not more than 12.5 μm, and wherein the Fe-based amorphous alloy ribbon has an ahoy composition represented by $Fe_aSi_bB_cC_dM_e$ wherein M is one or more elements selected from the group consisting of Cr, Mo, Mn, Zr and Hf; and a, b, c, d and a are atomic percentages satisfying relationships of $50 \leq a \leq 90$, $5 < b < 13$, $2 \leq c \leq 15$, $0 < d \leq 3$, $0 < e < 5$, $b+c+d < 23$ and $a+b+c+d+e=100$.

2. The dust core according to claim 1, wherein a surface thereof is coated with silicone rubber and the silicone rubber is coated with an epoxy resin.

3. A choke formed as a coil by winding a conductor wire around the dust core of claim 2 a plurality of times.

4. The dust core according to claim 1, wherein a core loss at a frequency of 50 kHz and a magnetic flux density of 50 mT is 70 $kW/m^3$ or less and relative permeability in a magnetic field of 10000 A/m is 30 or more.

5. A choke comprising:

a resin case; and the dust core of claim 1 housed in the resin case, wherein the dust core is fixed on an inside of the resin case with silicone rubber and formed as a coil by winding a conductor wire around an outer face of the resin case a plurality of times.

6. The dust core according to claim 1, wherein the ends of the two principal planes include angular edges formed by pulverizing the Fe-based amorphous alloy ribbon with an impact mill.

7. The dust core according to claim 1, wherein the Cr-containing Fe-based amorphous alloy atomized spherical powder has a composition represented by $Fe_{74}B_{11}Si_{11}C_2Cr_2$.

* * * * *